US006202248B1

(12) United States Patent
Faires

(10) Patent No.: US 6,202,248 B1
(45) Date of Patent: Mar. 20, 2001

(54) JUST RIGHT BRUSH

(75) Inventor: Everardo D Faires, 6239 NW. 17 St., Margate, FL (US) 33063

(73) Assignee: Everardo D Faires, Margate, FL (US)

( * ) Notice: Subject to any disclaimer, the term of this patent is extended or adjusted under 35 U.S.C. 154(b) by 0 days.

(21) Appl. No.: 09/351,347

(22) Filed: Jul. 12, 1999

Related U.S. Application Data

(60) Provisional application No. 60/092,574, filed on Jul. 13, 1998.

(51) Int. Cl.[7] ..... A46B 9/04

(52) U.S. Cl. ..... 15/167.1; 15/106; 15/172; 15/201

(58) Field of Search ..... 15/106, 167.1, 15/169, 172, 184, 201

(56) References Cited

U.S. PATENT DOCUMENTS 1,189,698 * 7/1916 Keating ..... 15/184
1,592,207 * 7/1926 Havrilla ..... 15/167.1
4,409,701 * 10/1983 Perches ..... 15/167.1
5,350,248 * 9/1994 Chen ..... 15/167.1 X

FOREIGN PATENT DOCUMENTS

647429 * 10/1962 (IT) ..... 15/169

* cited by examiner

*Primary Examiner*—Mark Spisich

(57) ABSTRACT

A toothbrush that allows a better, less painfull cleaning. By combining a multi texture bristle brush with an adjustable brush, it makes a toothbrush that's just right for cleaning the surface of the teeth and reaching the uneven areas which require cleaning also. The gums and gumlines can also get the required cleaning they need without hurting them or wearing them down faster, it produces desire results with the ability of making the task easy.

1 Claim, 2 Drawing Sheets

JUST RIGHT BRUSH

CROSS REFERENCE TO RELATED APPLICATION

This application claims priority under 35 USC 119(e) of provisional application 60/092,574,filed Jul. 13, 1998.

BACKGROUND OF INVENTION

1. Field of Invention

Because there are several problems with the cleaning of the teeth with a regular toothbrush, I invented the Just Right Brush. One problem is that to clean areas of the teeth that are uneven and hard to reach, extra pressure is applied with the brush. This wears down the gum line much faster as well as bruises and even cause bleeding.

When I invented the Just Right Brush I did not see any of the many different toothbrushes that are now in the market. And today after testing out the different types of toothbrush that are made to reach the uneven areas of the teeth, I see that the problem is still the same or different even worse with some toothbrushes. And that none can provide all that the Just Right Brush can.

2. Description of Related Art

The Just Right Brush is like having two completely different toothbrushes in one, where it allows the use of each one by itself. It has one set of bristles that is firm and permanently mounted on the handle, without any adjustment. The second set of bristles is softer and, it is adjustable, it is mounted on a flat piece of plastic that is inside the handle. Inside there is enough space to allow movement of the piece of plastic and the soft brittles. By being able to adjust the soft brittles to extend above (to be longer, than) the firm none adjustable set of brittles, or to adjust inward (to be shorter than) below the firm set of brittles, the areas were the teeth are deeper (uneven) can be brush without having to apply extra presure, or without any other different length of bristles in the way.

BRIEF SUMMARY OF THE INVENTION

As well as stated on the back ground of invention, the Just Right Brush has other advantageous over other toothbrushes. The gums and gumlines can be easily cleaned without pain, by just adjusting the soft bristles longer than the firmer bristles. It also can brush effectively the areas that require a firm set of bristles, like the top of the teeth that's used to chew the food. Unlike other multi bristle toothbrushes, the Just Right Brush will not have any other different length of bristles in the way. Because if you are trying to use the shorter set of bristles the longer set will either be in the way or, you would have to apply extra pressure to use the shorter ones, and end up over using the longer ones. The Just Right Brush will also help reach well between the teeth.

DETAIL DESCRIPTION OF INVENTION

The Just Right Brush is a two in one toothbrush. With one set of bristles of a firm texture, and the other set of bristles is of soft texture. Also the soft set of bristles are adjustable. It is like a regular toothbrush with a second toothbrush built in.

It is very easy to use. To use the teeth are cleaned with the soft adjustable set in a inward position where they are shorter than the firm set. The surface of the teeth are cleaned, then the soft adjustable set is adjusted above the firm set where they are longer than the firm set. Now the rest of the teeth are cleaned, reaching between them where it is deeper and hard to reach. Also the gums and gumlines can be cleaned with little or no pain.

Figure 1:
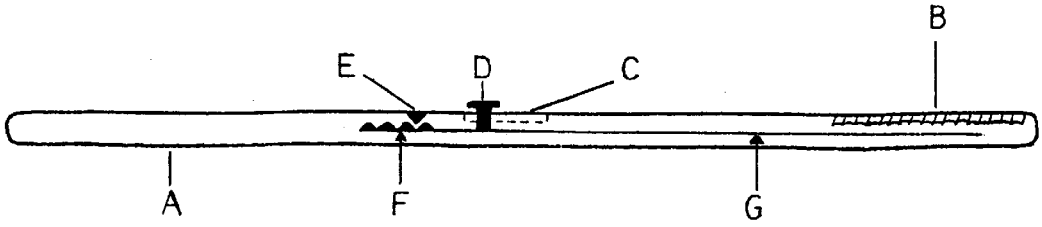
FIG. 1 is the handle of the Just Right Brush without the britles.
Figure 2:
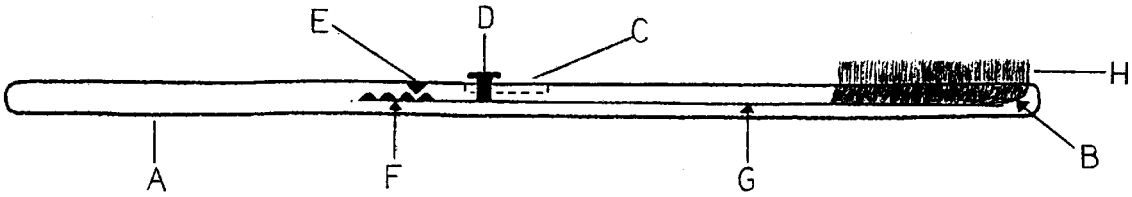
FIG. 2 is the handle of the Just Right Brush with the adjustable soft britles on the flat movable piece of plastic.
Figure 3:
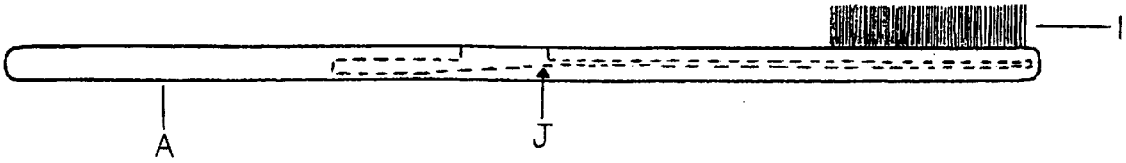
FIG. 3 is the handle with the firm set of non-adjustable britles.
Figure 4:
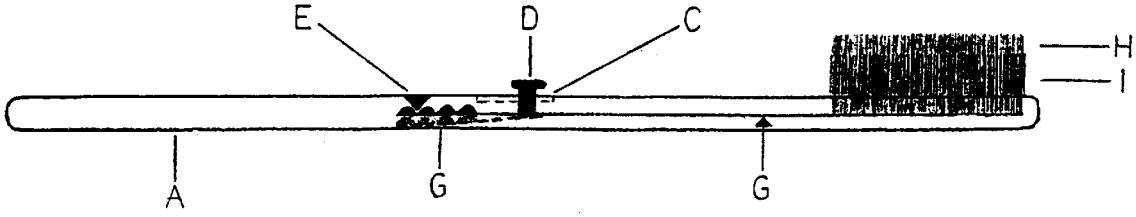
FIG. 4 shows both sets of britles still with a transparent view.
Figure 5:
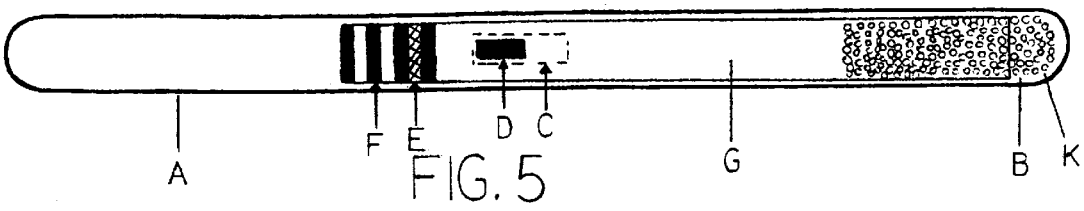
FIG. 5 is a top view of the toothbrush without the britles.
Figure 6:
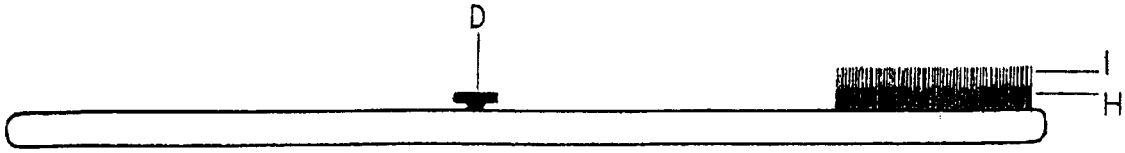
FIG. 6 is the complete toothbrush with the soft set of britles at a lower (shoter) adjusted length than the firmer set of britles.
Figure 7:
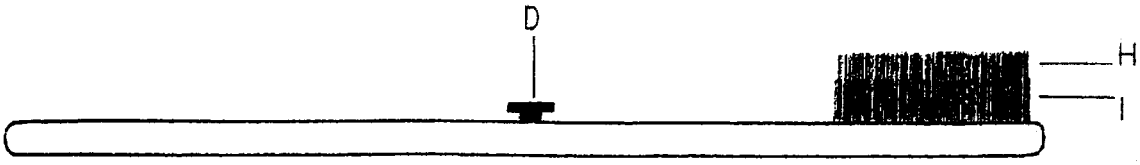
FIG. 7 is the complete toothbrush with the soft set of britles at a higher (longer) adjusted length than the firmer set of britles.

FIG. 1 shows the toothbrush without the brittles, (A) is the toothbrush handle, (B) is the tunnel like little opening (grooves) where the (H) soft brittles slide thru, they also guide them to an upright position. The soft brittles are mounted on (G), (G) is a flat piece of plastic with small humps (F) at the other end of it, and a nipple that's like a push button (D). There is a space inside (J) for (G) to seat and be able to move as needed, this is seen on FIG. 3. Part of (J) is drawn in dashes, this is the opening guide (C) for (D). (E) is a single hump inside the handle, it does not move or is part of (G). (E) sits between (F), both (E) & (F) together hold (G) in place, and is for the diferent length setting. FIG. 2 (H) are the soft brittles mounted on (G) the flat piece of plastic that is to moved back and forth, (H) is inside the small grooves (B) guiding (H) to an upright position. FIG. 3 (I) are the firm set of bristles permanently mounted on (A). The dash lines represent the space (J) where (G) sits and slides back and forth to adjust the length of the soft brittles (H), and also allows (G) to bend downward at the end opposite end where the bristles are mounted, and where the push button protrudes thru, this opening is also at (C). FIG. 4 shows (H) the soft brittles adjusted out on (G). (D) is towards the front, the firm (I) set of non adjustable bristles are also on the toothbrush, and (G) can be seen drawn in dashes bent down, to unlock and allow adjustment, showing how it works. The humps (F) and part of (D) then nipple are drawn in dots. FIG. 5 is a top view of the toothbrush handle (A) showing (C), (D), (E), & (F). (E) is drawn in a crisscross pattern. (G) can be seen as well as (B) & (K). (K) are the holes where the firm (H) brittles are mounted, both (B) & (K) are mix together in a skipping alternating fashion. FIG. 6 shows the Just Right Brush complete with (H) the soft brittles adjusted lower (below) (I) the firm set of brittels, and (D) is towards the bottom end of the toothbrush, because its set with the (H) soft brittles adjusted inward. FIG. 7 shows the completed Just Right Brush with (H) the soft brittles adjusted higher (above) (I) the firm set of bristles, and (D) is towards the front end (the end with the bristles) of the toothbrush, because it is set with the (H) soft brittles outward.

What is claimed is:

1. A toothbrush comprising:

a) an elongated handle having a plurality of firm bristles fixed to and extending from a distal portion thereof, the distal portion of the handle further including a plurality of holes among the firm bristles, the handle including an elongated channel therein which extends to the distal portion thereof, the handle further including an elongated opening spaced from the distal portion and in communication with said channel, and a hump adjacent said opening and protruding into said channel;

b) a member located in said handle and adapted for sliding movement in and along said elongated channel, said member having a plurality of soft bristles extending from an end portion thereof, said soft bristles extending through the holes which are among the firm bristles, said member including a plurality of spaced protrusions extending therefrom and spaced from said bristles, and further including a button extending therefrom and through the elongated opening in the handle so that the user may depress it, said button located between the plurality of protrusions and the soft bristles; and c) wherein said member may be slid along the length of the handle so as to change the effective length of the soft bristles, the soft bristles being adapted to extend above the height of the firm bristles as well as below the height of the firm bristles, the plurality of spaced protrusions on said member cooperating with said hump to maintain the member and thus the soft bristles in a selected position, the protrusions being disengaged with the hump and the member moved along the handle upon depression of the button by the user and moving the button along the length of the elongated opening in the handle.

* * * * *